United States Patent [19]

Umino et al.

[11] Patent Number: 4,986,094

[45] Date of Patent: Jan. 22, 1991

[54] APPARATUS FOR DYEING OR OTHERWISE TREATING AN ELONGATE FABRIC MATERIAL

[75] Inventors: Mitsugu Umino, Uozu; Kiyoshi Nakayama, Kurobe, both of Japan

[73] Assignee: Yoshida Kogyo K.K., Tokyo, Japan

[21] Appl. No.: 448,640

[22] Filed: Dec. 11, 1989

[30] Foreign Application Priority Data

Dec. 16, 1988 [JP] Japan ..... 63-318929
Dec. 22, 1988 [JP] Japan ..... 63-323989

[51] Int. Cl.[5] ..... D06B 17/04; D06B 23/04

[52] U.S. Cl. ..... 68/27; 68/164; 68/199

[58] Field of Search ..... 68/27, 148, 149, 159–164, 68/188, 199

[56] References Cited

U.S. PATENT DOCUMENTS

| | | | |
|---|---|---|---|
| 569,453 | 10/1896 | Gleason et al. | 68/163 |
| 1,195,646 | 8/1916 | Bendsch | 68/164 |
| 1,670,067 | 5/1928 | Giles et a l. | 68/162 |
| 2,460,325 | 2/1949 | Whitson et al. . | |

FOREIGN PATENT DOCUMENTS

| | | | |
|---|---|---|---|
| 123765 | 9/1902 | Fed. Rep. of Germany | 68/199 |
| 1464607 | 1/1967 | France . | |
| 2427417 | 12/1979 | France . | |
| 20011 | of 1900 | United Kingdom | 68/149 |
| 260309 | 10/1926 | United Kingdom | 68/161 |
| 1092927 | 11/1967 | United Kingdom . | |

*Primary Examiner*—Philip R. Coe

*Attorney, Agent, or Firm*—Hill, Van Santen, Steadman & Simpson

[57] ABSTRACT

A dyeing apparatus for dyeing or otherwise treating an elongate fabric material includes a cylindrical vessel and a beam mounted concentrically therein and removable therefrom the beam having a plurality of chambers isolated one from another and a dye frame unit rotatably mounted on a driven shaft extending axially through the beam, a first motor rotating the driven shaft and a second motor operatively associated with a mechanism for moving the driven shaft axially toward and away from the first motor, and away from the driven shaft to adjust the overall diameter of the dye frame unit on which the fabric material is wound.

6 Claims, 6 Drawing Sheets

APPARATUS FOR DYEING OR OTHERWISE TREATING AN ELONGATE FABRIC MATERIAL

BACKGROUND OF THE INVENTION

1. Field of the Invention

This invention relates to a method of and apparatus for dyeing or otherwise treating fabrics in the form of cloth, tapes, yarns and other elongate materials.

2. Prior Art

An apparatus known in the art of fabric dyeing typically comprises a cylindrical vessel in which hot dye liquor is circulated, and a cylindrical beam rotatably mounted on a drive shaft journalled in the vessel and having wound thereon a fabric material to be dyed. Since the beam was only rotatable with the shaft and held otherwise immovable, the material wound on the beam was susceptible to swelling or shrinking on contact with heated dye medium and consequently pressed under increased tension against the periphery of the beam. This would lead to insufficient dye penetration in the areas of the fabric material which were held in close contact with the beam, and as a result, it was difficult to dye the material homogeneously throughout its entire dimensions. This problem would become aggravated in the case of dyeing a chain of slide fastener stringers where the chain was subjected to excessive tension particularly in the region of the coupling head portions in the rows of coupling elements secured to the tape edges, resulting in deformed or otherwise inoperative coupling elements.

SUMMARY OF THE INVENTION

It is therefore the primary object of the present invention to provide an apparatus for dyeing fabric materials which will eliminate the foregoing difficulties of the prior art.

A more specific object of the invention is to provide a beam dyeing apparatus which has a means of controlling the tension in a fabric material so as to compensate for the amount of shrinkage developed in the material during the dyeing operation.

The above and other objects and features of the invention will become more apparent from the following detailed description of the invention taken in conjunction with the accompanying drawings.

According to the invention there is provided an apparatus for dyeing or otherwise treating an elongate fabric material including slide fastener stringers which will accommodate winding the fabric material on a rotatable frame means disposed in a dye chamber and reducing the diameter of the frame means to an extent necessary to compensate for the amount of shrinkage developed in the fabric material during the dyeing operation.

According to the invention there is also provided a dyeing apparatus for dyeing or otherwise treating elongate fabric materials including slide fastener stringers which comprises a horizontally mounted cylindrical vessel provided at one end with a removable dished end cover and at the opposite end with a vertical end wall, a cylindrical beam concentrically mounted within said vessel and removable therefrom, a driven shaft extending axially and centrally through said beam, a first motor adapted to rotate said driven shaft, a second motor operatively connected to means for moving said driven shaft axially toward and away from said first motor, a plurality of partition walls disposed in spaced parallel relation and separating said beam into a plurality of independent dye chambers, a dye frame unit having a pair of annular spaced parallel support rims and a pair of spaced parallel arm assemblies each having a plurality of equally spaced radial arms, and a cam lever connected via a hub to and movable radially toward and away from said driven shaft to adjust the overall diameter of said dye frame unit on which is mounted a fabric material.

DETAILED DESCRIPTION OF THE INVENTION

Figure 1:
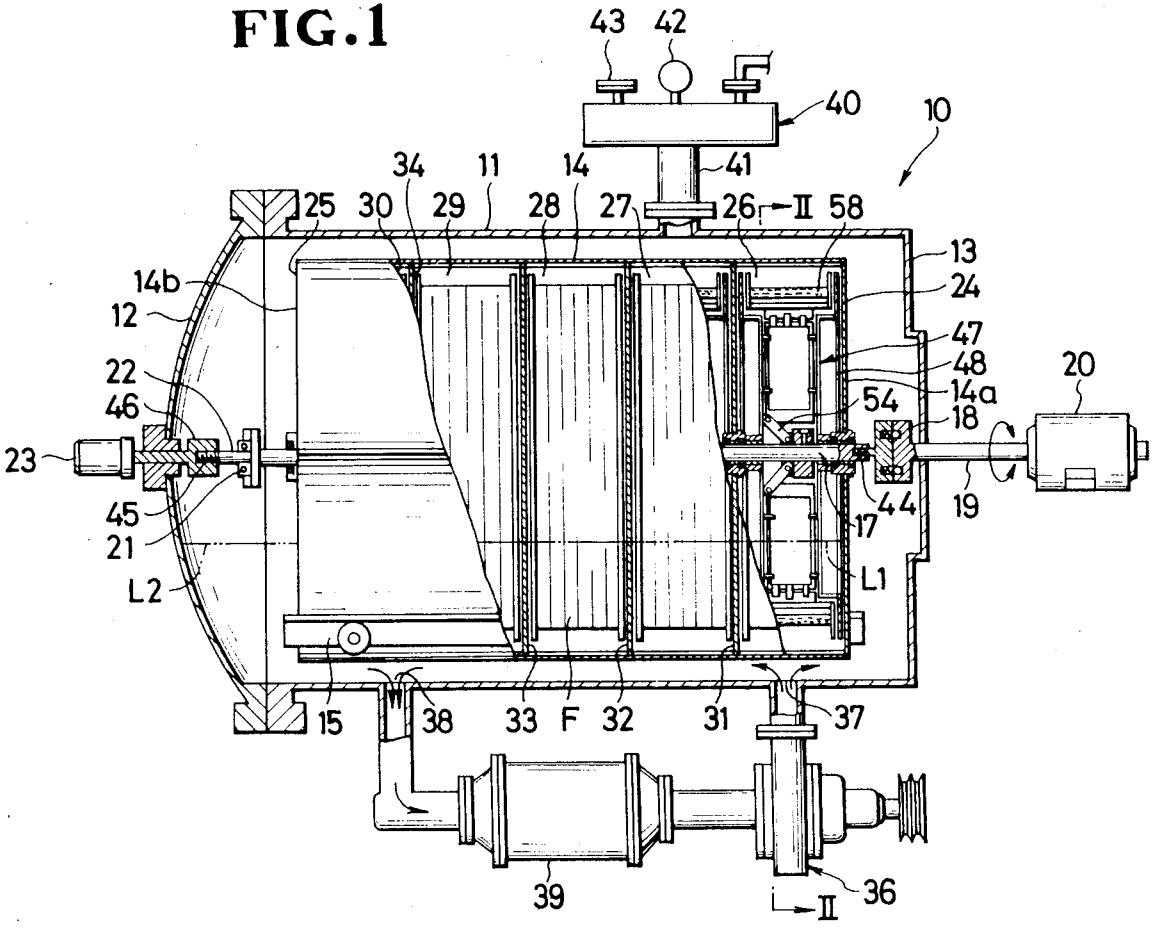
FIG. 1 is an elevational, partly sectional, view of a beam dyeing apparatus embodying the invention.

Referring now to the drawings and FIG. 1 in particular, there is shown a beam dyeing apparatus 10 for dyeing or otherwise treating a fabric material F in the form of cloth, tapes, yarns and other elongate textile materials including a slide fastener chain. The apparatus 10 comprises a horizontally mounted cylindrical treatment vessel 11 having a circular cross-section (FIG. 2) and provided at one end with an outwardly dished end cover 12 which is removable and at the opposite end with a vertical end wall 13.

Designated at 14 is a cylindrical beam concentrically mounted within the vessel 11 and may be placed into and out of the vessel 11 conveniently on a pair of guide rails 15 and 16 (better shown in FIG. 2) secured to the bottom of the vessel 11. A driven shaft 17 extends axially centrally through the beam 14 and is operatively connected to a series of dye frames later described.

The beam 14 is mounted with one or rear end **14*a* connected via coupling 18 to a first drive shaft 19 of a first motor 20 and the other or front end 14*b* connected via bearing 21 to a second drive shaft 22 of a second motor 23**.

Operation of the first motor 20 rotates the dye frames, while operation of the second motor 23 causes the driven shaft 17 to move axially in either direction in a manner hereafter to be described.

The beam 14 is closed a both ends by respective circular end walls 24 and 25 and separated into a plurality of independent dye chamber 26, 27, 28, 29 and 30 by spaced parallel partition walls 31, 32, 33 and 34. The beam 14 is thus hermetically sealed except at its upper portion where there is provided a hinged flapper lid 35 in each of the dye chambers 26–30. The lid 35, as better shown in FIG. 2, may be opened to feed or remove a dye liquor and wind or rewind the fabric material F.

A heating medium such as hot water is fed into the vessel 11 from a supply source 36 provided externally of and at the bottom of the vessel 11. The heat medium is pumped through an inlet 37 to a level indicated at $L_1$ and circulated back through an outlet 38 and past a heat-exchanger 39. The construction of this supply unit is well known and hence will require no further explanation.

At the top of the vessel 11 is provided a pressure fluid supply unit 40 for supplying for instance compressed air into the vessel 11 to maintain its interior pressure at a predetermined level, the unit 40 comprising a valved conduit 41 communicating with the vessel 11, a pressure meter 42 and a control valve 43. This unit construction is also conventional and hence will require no further explanation.

A resilient means such as a spring 44 is interposed between the coupling 18 and the rear end of the driven shaft 17 to normally urge the shaft 17 axially toward the front end 25 of the beam or toward the second motor 23.

The second drive shaft 22 is threaded as at 45 at an opposite end to the bearing 21 and engaged with a nut 46 so that rotation of the second motor 23 in one direction causes the second drive shaft 22 to advance axially of the beam 14 and move the driven shaft 17 likewise axially toward the rear end 24 of the beam 14 or toward the first motor 20 against the tension of the spring 44. Rotation of the second motor 23 in the opposite direction causes the second drive shaft 22 to retract axially and move the driven shaft 17 likewise axially backward toward the front end 25 of the beam 14 or toward the second motor 23.

Means of effecting axial movement of the driven shaft 17 may be of other construction than that just described as appears obvious to those skilled in the art.

The dye chambers 26–30 are isolated one from another and can be filled each with different color dyestuffs to facilitate treatment of the fabric material F with so many different colors as are the number of dye chambers 26–30.

Figure 2:
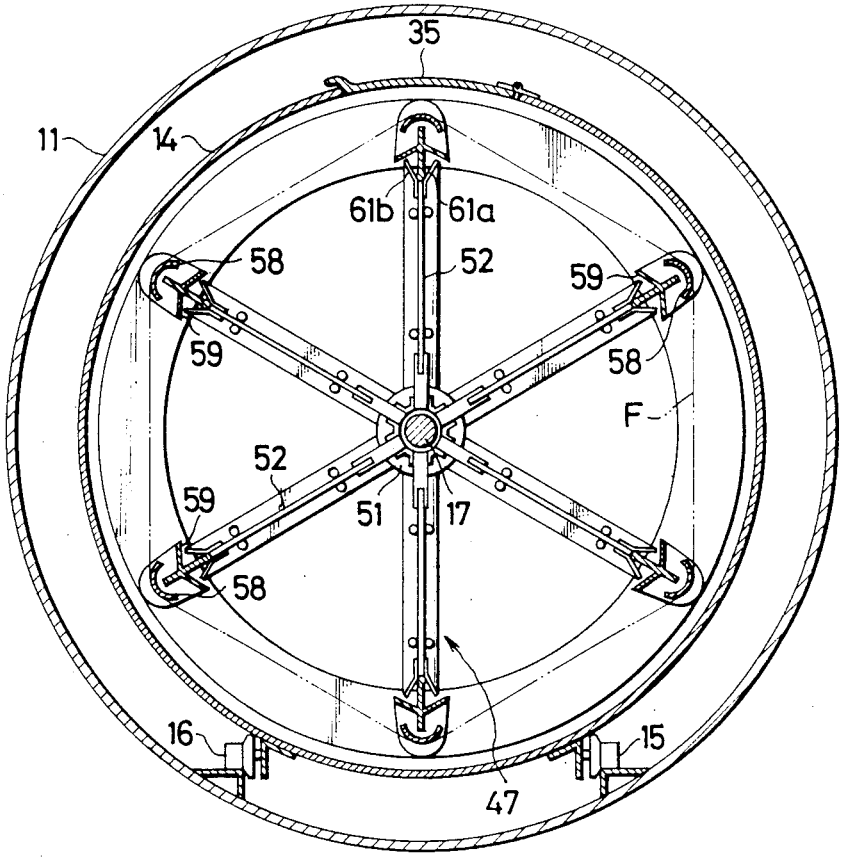
FIG. 2 is a cross-sectional view on enlarged scale taken on the line II—II of FIG. 1.
Figure 3:
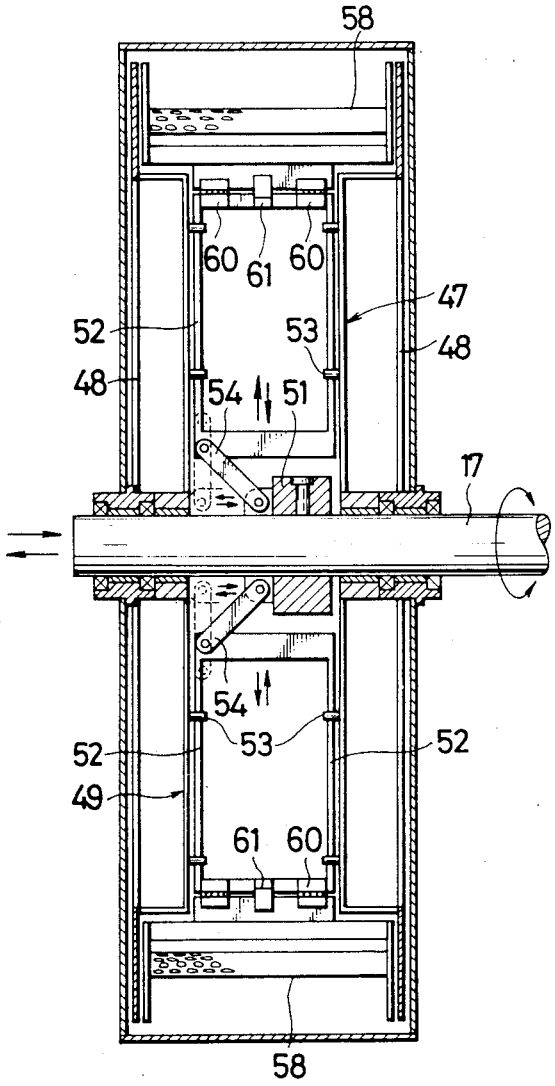
FIG. 3 is a transverse cross-sectional view on enlarged scale of a portion of the apparatus of FIG. 1.

Rotatably mounted in each of the chambers 26–30 is a dye frame unit 47 generally in the form of a wheel which comprises a pair of annular, equally spaced, parallel support rims 48, 48 and a pair of spaced parallel arm assemblies 49 each having a plurality of equally spaced radial arms 50 each of which extends radially at one end from a hub 51 secured to the driven shaft 17 and is connected at the other end to the respective annular support rim 48 as better shown in FIGS. 2 and 3.

Figure 4:
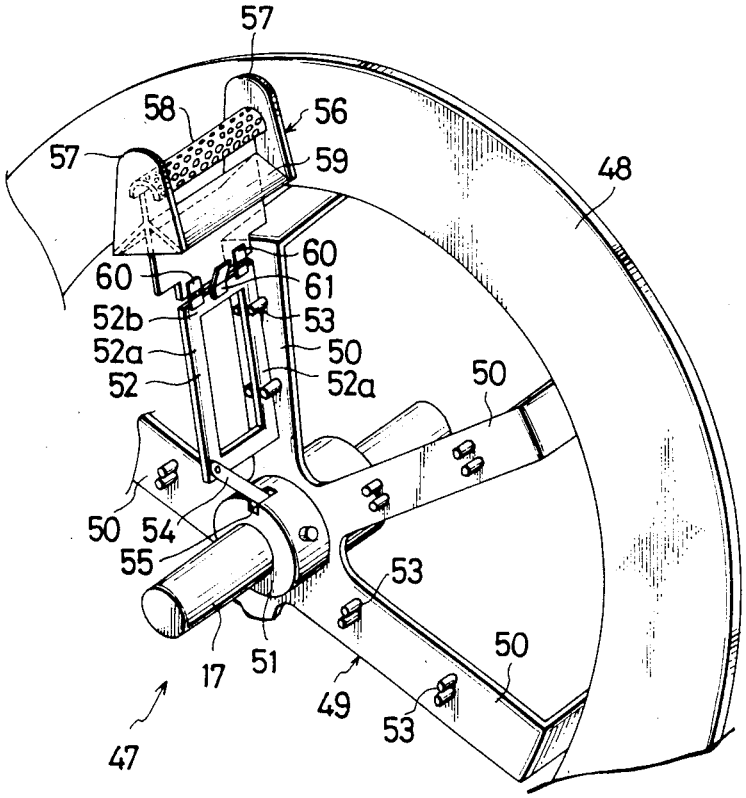
FIG. 4 is a perspective view on enlarged scale of a portion of the apparatus of FIG. 1.

Each dye frame unit 47 further comprises a cam lever 52 generally in the form of a rectangular frame, as better shown in FIG. 4, which has longitudinal vertical side portions **52*a* supported between a pair of spaced pins 53 extending axially from each arm 50. To the lower end of one of the vertical side portions 52*a* of the cam lever 52 is pivotally connected one end of a link 54 whose other end is supported in a slot 55 formed in the hub 51**.

The dye frame unit 47 further includes a flip-flop vane 56 having a pair of spaced parallel vertical support lugs 57, a cross-sectionally elliptical perforated hanger 58 interposed between the support lugs 57, and a cross-sectionally inverted-Y member 59 integral with the support lugs 57 and hingedly connected as at 60 to the upper end portion **52*b* of the cam lever 52, as better shown in FIG. 4**.

Figure 5:
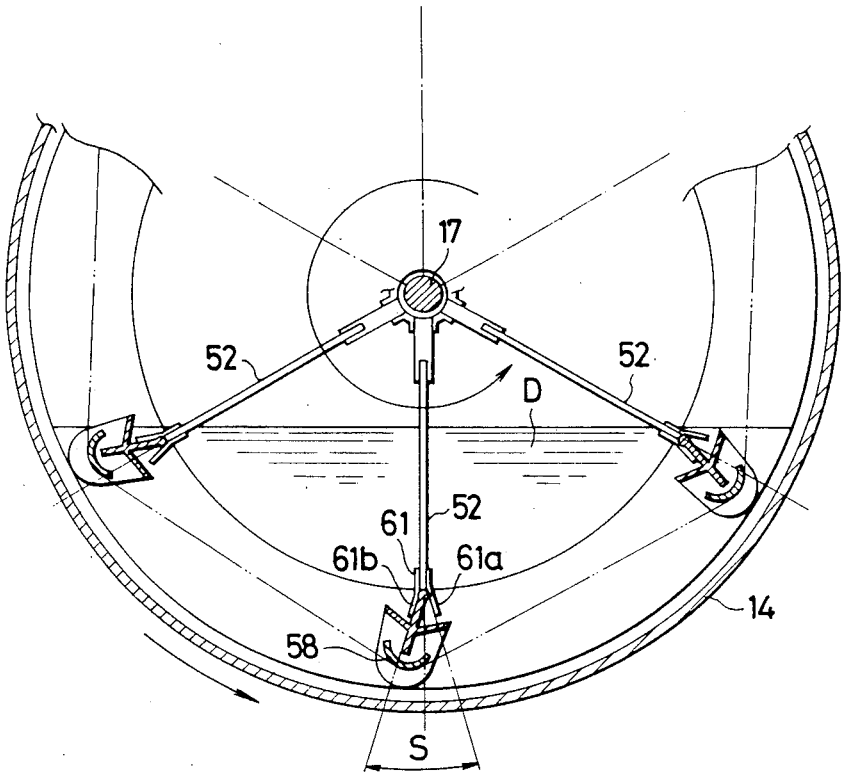
FIG. 5 is a transverse cross-sectional view on enlarged scale of a portion of the apparatus of FIG. 1, showing the same in one mode of operation.
Figure 6:
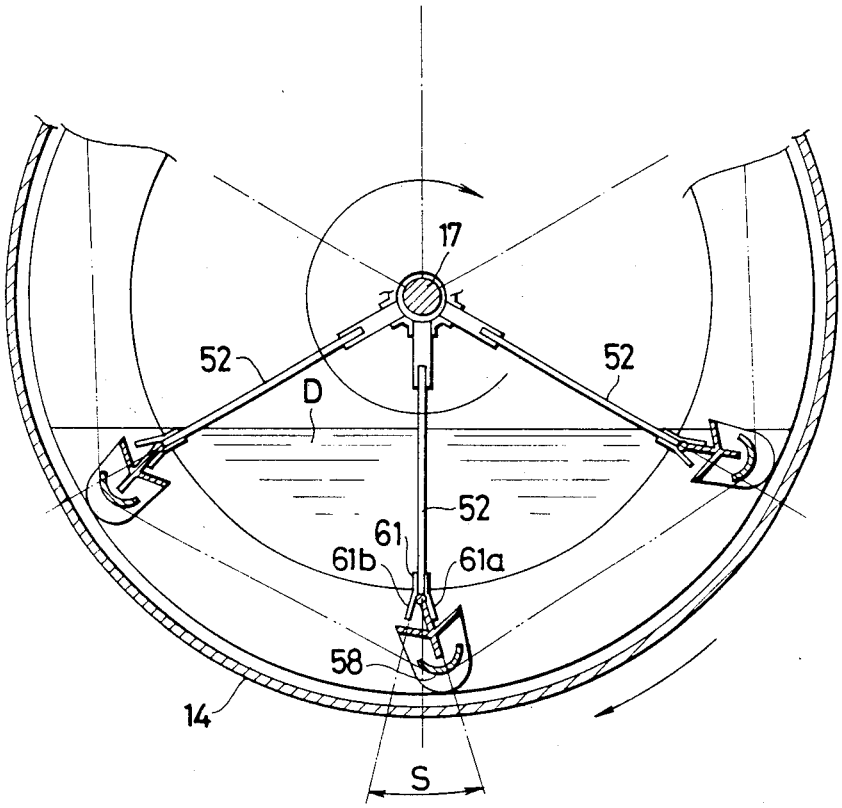
FIG. 6 is a view similar to FIG. 5 but showing the apparatus in another mode of operation.

Designated at 61 is a flip-flop limiter secured to the upper end portion **52*b* of the cam lever 52 and having outwardly diverged limiter arms 61*a* and 61*b* defining therebetween the extent of flip-flop or pivotal movement of the flip-flop vane 56 as better shown in FIGS. 5 and 6**.

The advantage of the member 59 being inverted-Y shaped is found in accelerated penetration of a dye liquor, as this liquor can be kicked up dispersedly into and through the layers of fabric F wound around the hangers 58 in each dye chamber 26–30.

In operation of the dyeing apparatus 10 thus constructed, a dye liquor or liquors D is filled in each of the dye chamber 26–30 to a predetermined level $L_1$, with compressed air and heating medium supplied to the vessel 11 from their respective sources 40 and 36. As the fabric material F wound on and around the hangers 58 in the dye frame unit 47 becomes shrunk or contracted in immersed contact with the dye liquor D, the driven shaft 17 is moved axially in a direction to cause all of the links 54 to tilt pivotally downwardly which in turn pull the flip-flop vanes 56 radially inwardly via the cam levers 52 thereby reducing the overall diameter of the frame unit 47 to an extent corresponding to the amount of contraction of the fabric F, or stated otherwise to compensate for shrinkage of, or adjust the tension in the fabric F during treatment with the dye liquor D. Since the flip-flop vanes 56 are pivotally connected to the levers 52, they flip toward and abut against one of the arms **61*a* and 61*b* of the flip-flop limiter 61 during rotation of the dye frame 47 in one direction and flop toward and abut against the other of the limiter arms 61*a* and 61*b* as the direction of rotation of the frame unit 47 is reversed, as illustrated in FIGS. 5 and 6**.

On account of the above flip-flop movement of the vanes 56 the fabric material F becomes slightly shifted in place at its portions in contact with the hangers 58 so as to eliminate irregularities in the dye finish which would otherwise develop with conventional dye beams. Another advantage of the apparatus 10 according to the invention is that with shifting or changing contact position of the material F with respect to the hangers 58, the portions of the material F which have been warped or sagged will stretch straight out and the portions of the material F which have been held taut will conversely become warped or sagged. This behavior of the material F is repeated so as to maintain shrinkage and related physical properties of the material F uniform throughout its entire dimensions.

In order to ensure smooth flip-flop movement of the vanes 56, the tension applied to the fabric material F wound in the dye frame unit 47 should be adjusted by moving the driven shaft 17 axially in one or the other direction in a manner already described. The axial stroke of the driven shaft 17 can be automatically controlled by a control signal supplied to the second motor 23, which signal represents an operating parameter based for example on the relations between the temperature of the dye liquor D, the length of dyeing time and the extent of shrinkage of the particular item of material F to be dyed.

Obviously, various modifications and variations of the present invention are possible in the light of the above teaching. It is therefore to be understood that within the scope of the appended claims the invention may be practiced otherwise then as specifically described.

As for an example, the vanes 56 may be fixedly connected to the cam levers 52, or the hangers 58 alone may be directly connected to the levers 52.

What is claimed is:

1. A dyeing apparatus for dyeing or otherwise treating an elongate fabric material including slide fastener stringers which comprises a horizontally mounted cylindrical vessel provided at one end with a removable end cover and at the opposite end with a vertical end wall, cylindrical beam concentrically mounted within said vessel and removable therefrom, a driven shaft extending axially and centrally through said beam, a first motor adapted to rotate said driven shaft, a second motor operatively connected to means for moving said driven shaft axially toward and away from said first motor, a plurality of partition walls disposed in spaced parallel relation and separating said beam into a plurality of independent dye chambers, a dye frame unit disposed adjacent said vessel and having a pair of spaced parallel support rims and a pair of spaced parallel arm assemblies each having a plurality of equally spaced arms, and a cam lever connected via a hub to said driven shaft and to said frame unit so as to be movable radially toward and away from said driven shaft to adjust the overall diameter of said dye frame unit on which is mounted a fabric material.

2. A dyeing apparatus according to claim 1 wherein said dye frame unit further includes a flip-flop vane pivotally connected to said cam lever and a flip-flop limiter adapted to restrict the pivotal movement of said vane.

3. A dyeing apparatus according to claim 1 wherein said dye frame unit further includes a link connected at one end to said hub and at the other end to said cam lever to raise and lower the latter as said driven shaft moves axially.

4. A dyeing apparatus according to claim 1 further including a resilient means normally urging said driven shaft axially toward said second motor.

5. A dyeing apparatus according to claim 4 wherein said means comprises a threaded end portion of said driven shaft and a nut engaged therewith.

6. A dyeing apparatus according to claim 1 wherein each of said dye chambers is hermetically sealed except at an upper portion of said beam to which a flapper lid is hingedly connected.

* * * * *